US005190485A

United States Patent [19]

Ransdell

[11] Patent Number: 5,190,485

[45] Date of Patent: Mar. 2, 1993

[54] ELECTRICAL TERMINATION LUG

[76] Inventor: Jimmy D. Ransdell, P.O. Box 1691, North Platte, Nebr. 69103

[21] Appl. No.: 829,696

[22] Filed: Feb. 3, 1992

[51] Int. Cl.[5] ..... H01R 11/09

[52] U.S. Cl. ..... 439/798; 439/810

[58] Field of Search ..... 439/721, 723, 724, 727, 439/797, 798, 810, 811, 812, 813, 814

[56] References Cited

U.S. PATENT DOCUMENTS

| | | | |
|---|---|---|---|
| 3,047,835 | 7/1962 | Kelly | 439/798 |
| 3,075,164 | 1/1963 | Humpage et al. . | |
| 3,243,764 | 3/1966 | McGrane et al. | 439/798 |
| 3,534,195 | 10/1970 | Klein et al. | 200/166 |
| 3,725,851 | 4/1973 | Linn | 439/798 |
| 3,760,342 | 9/1973 | Prouty et al. . | |
| 3,876,279 | 4/1975 | Underwood . | |
| 4,093,970 | 6/1978 | M'Sadoques et al. | 361/361 |
| 4,327,957 | 5/1982 | Cooper, Jr. et al. . | |
| 4,603,376 | 7/1986 | Maier | 361/426 |
| 4,708,418 | 11/1987 | Reyna | 439/797 |
| 4,809,132 | 2/1989 | Palmieri et al. | 361/353 |

FOREIGN PATENT DOCUMENTS

| | | | |
|---|---|---|---|
| 1229880 | 9/1960 | France | 439/798 |

*Primary Examiner*—Larry I. Schwartz
*Assistant Examiner*—Khiem Nguyen
*Attorney, Agent, or Firm*—Zarley, McKee, Thomte, Voorhees & Sease

[57] ABSTRACT

An electrical termination lug is described comprising a block member having a top portion, bottom portion, front portion, back portion, and opposite side portions. The block member has a first opening formed therein which is adapted to receive a large electrical connector therein. A set screw threadably extends into the block member for engagement with the large connector in the first opening to maintain the large connector in the first opening. The block member is provided with one or more openings formed therein adapted to receive small connectors therein or which are adapted to secure small connectors to the block member.

4 Claims, 2 Drawing Sheets

ELECTRICAL TERMINATION LUG

BACKGROUND OF THE INVENTION

This invention relates to an electrical termination lug and more particularly to an electrical termination lug which provides a means for connecting a larger conductor and one or more taps for smaller conduction within the same device.

For many years, electricians have put copper and aluminum conductors together or copper to copper conductors within the same opening with a lug only being listed and labeled for a single large conductor. Most electrical termination lugs are rated for a larger conductor but are not rated for smaller conductors.

In some installations, a much smaller tap is required from a larger conductor. It is a common practice to do this in the same opening with the lug with the larger conductor, and it is a violation of the National Electric Code.

It is therefore a principal object of the invention to provide an improved electrical termination lug.

A further object of the invention is to provide an electrical termination lug which fits all makes of panel boards and switchboards.

Still another object of the invention is to provide an electrical termination lug which may be mounted in all makes of motor control centers, pump panels, disconnect switches, main and feeder breakers and switches, etc.

Yet another object of the invention is to provide an electrical termination lug which permits small conductors to be tapped thereto without interfering with the large conductor which is connected to the device.

SUMMARY OF THE INVENTION

The electrical termination lug of this invention comprises a generally rectangular block member having a top portion, bottom portion, back portion, front portion, and opposite side portion. The block member is provided with a first opening extending therethrough which is adapted to receive a large conductor. The large conductor is maintained in the first opening by means of an allen or set screw threadably mounted on the lug which may be threadably moved into engagement with the large conductor. The block member is also provided with one or more second openings formed therein which may extend into any of the various portions thereof to enable smaller conductors to be operatively secured thereto. Means is provided for mounting the lug on control panels, motor panels, etc.

DESCRIPTION OF THE PREFERRED EMBODIMENT

Figure 1:
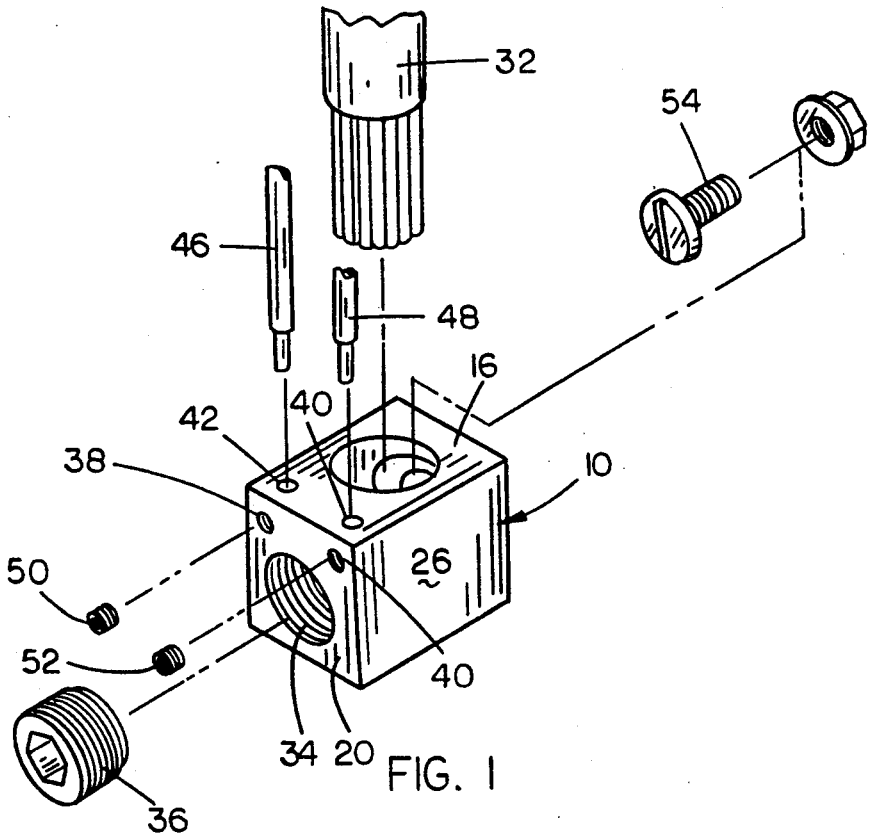
FIG. 1 is an exploded perspective view of the electrical termination lug of this invention.
Figure 3:
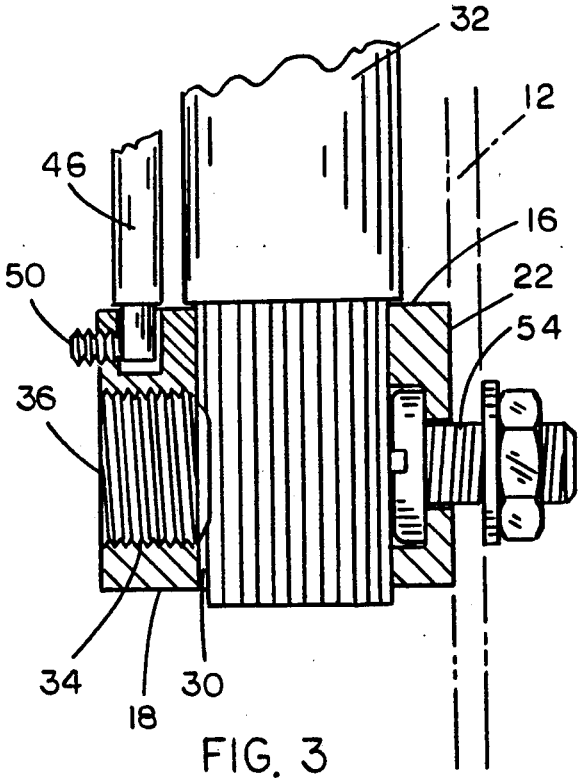
FIG. 3 is a vertical sectional view of the lug of FIG. 2.
Figure 6:
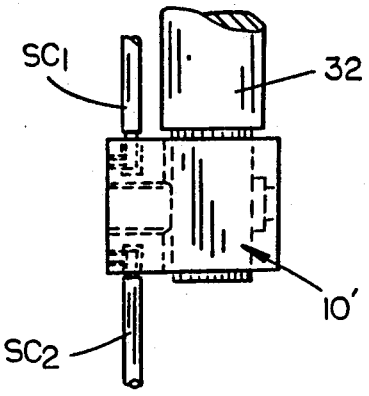
FIG. 6 is a side view of the lug of FIG. 5.
Figure 4:
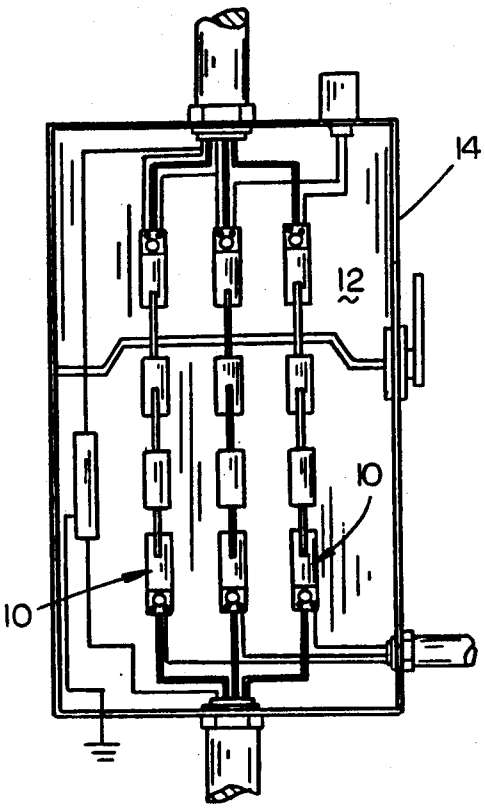
FIG. 4 is a front view illustrating a plurality of the lugs of this invention mounted in a panel board.

In FIG. 1, the numeral 10 generally designates the electrical termination lug of this invention. As seen in FIG. 3, the lug 10 may be secured to the buss bar 12 or other suitable separating structure of a panel board, switchboard, motor control center, pump panel, etc. In FIG. 4, a control panel 14 is illustrated which has a back wall 12 provided therein. In FIG. 4, a plurality of the lugs 10 are utilized.

Lug 10 generally comprises a rectangular block member constructed of conventional electrically conductive material and including a top portion 16, bottom portion 18, front portion 20, back portion 22, and opposite side portions 24 and 26. The designation of the lug as having a top portion or a bottom portion as well as a front portion or a back portion is merely for descriptive purposes only since the lug may be mounted in a variety of different positions.

Figure 2:
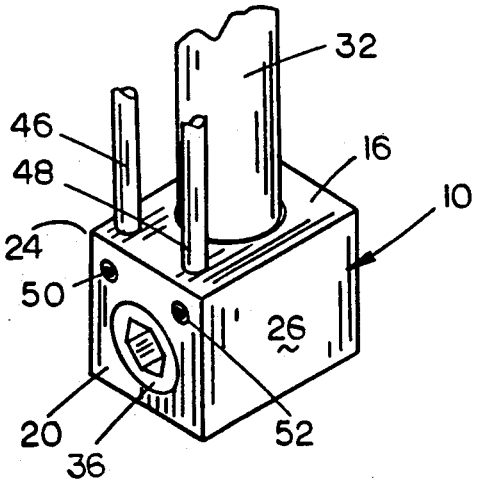
FIG. 2 is a perspective view illustrating the lug of this invention having a large conductor secured thereto and a pair of smaller conductors secured thereto.

In the preferred embodiment, lug 10 includes a large bore or opening 30 extending therethrough from the top portion 16 to the bottom portion 18 as best seen in FIG. 3. Opening 30 is adapted to receive a large conductor 32 as illustrated in FIGS. 2 and 3. Connector 32 is maintained in opening 30 by any convenient means such as that illustrated in FIG. 3. In FIG. 3, an internally threaded opening 34 extends into the front portion 20 of lug 10 and communicates with opening 30. Allen or set screw 36 is threadably mounted in the threaded opening 34 and is adapted to engage the connector 32 as illustrated in FIG. 3 to maintain connector 32 in opening 30.

The lug 10 is preferably provided with one or more threaded openings formed therein to permit the connection thereto of a smaller connector. For example, FIG. 1 illustrates a pair of threaded or tapped openings 38 and 40 formed therein which extend into the front portion 20 of lug 10. A pair of openings 42 and 44 extend into the lug 10 from the upper portion 16 as seen in FIG. 1 and communicates with the threaded openings 38 and 40, respectively. As seen in FIGS. 1–3, openings 42 and 44 are adapted to receive smaller conductors 46 and 48, respectively. Screws 50 and 52 or other suitable connectors are threadably received in the threaded openings 38 and 40, respectively, and are adapted to engage the smaller conductors 46 and 48 as illustrated in FIG. 3 to maintain the connectors in the openings 42 and 44.

The lug 10 may be secured to the buss bar 12 or other suitable supporting structure of the electrical equipment by any convenient means such as by the mounting bolt 54.

Figure 5:
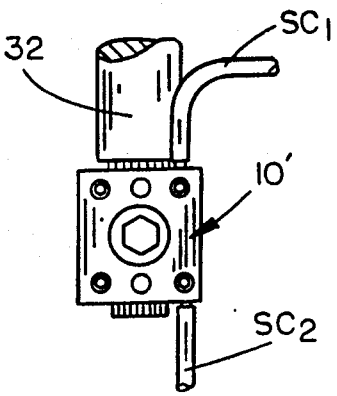
FIG. 5 is a front view illustrating a modified form of the lug.

FIG. 5 illustrates a modified form of the lug and is referred to generally by the reference numeral 10. In FIG. 5, it can be seen that the smaller conductors SC1 and SC2 extend into the top and bottom portions of the lug 10', respectively, while the conductor 32 extends downwardly into the lug as in the lug of FIG. 1.

Figure 7:
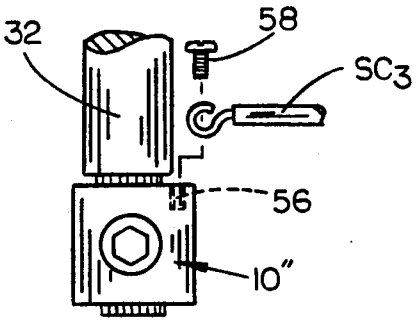
FIG. 7 is a front view of a modified form of the lug.

FIG. 7 illustrates yet another modified form of the lug wherein the reference numeral 10" identifies the lug. In FIG. 7, lug 10" includes a capped opening 56 which is adapted to threadably receive mounting screw 58. As seen in FIG. 7, the small connector SC3 is positioned between the head of the screw 58 and the lug 10 to connect the connector SC3 to the lug 10".

Figure 8:
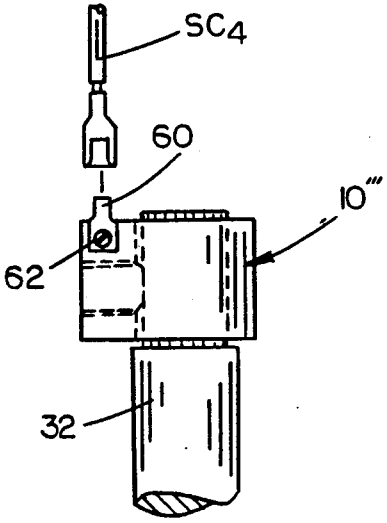
FIG. 8 is a front view of still another modified form of the lug.

FIG. 8 illustrates yet a further modified form of the invention wherein a flat terminal 60 is secured to the lug 10''' by means of mounting screw 62. Small connector SC4 is operatively secured to the terminal 60 as seen in FIG. 8.

Thus, it can be seen that a novel electrical termination lug has been provided which enables smaller connectors to be secured to the lug in a convenient and safe way which avoids the problems of the prior art. The lug of this invention enables the smaller connectors to be connected to the lug from any portion thereof by simply tapping openings in the lug and connecting the smaller terminals to the tapped openings. It can therefore be seen that the invention accomplishes at least all of its stated objectives.

I claim:

1. An electrical termination lug for connecting a large conductor and at least one smaller conductor to electrical equipment comprising, a block member having an upper end portion, a lower end portion, a front portion, a back portion, and opposite side portions, said block member having a first opening extending therethrough for receiving a large conductor, said first opening extending completely through said block member between its upper and lower end portions, first means for securing the large conductor in said first opening, means for securing said block member to said electrical equipment whereby the large conductor may extend upwardly into said first opening or extend downwardly into said first opening, at least a second opening formed in said block member spaced from said first opening and extending into one of said upper end portion, said lower end portion, said front portion, said back portion or one of said side portions for receiving a small conductor therein, and means for securing the small conductor in said second opening.

2. The lug of claim 1 wherein a plurality of second openings extend into said block member for receiving small conductors.

3. The lug of claim 1 wherein said second opening is internally threaded for threadably receiving a terminal screw therein which is electrically connected to the small conductor.

4. The lug of claim 1 wherein said means for securing said small conductor in said second opening comprises a screw means threadably extending into said block member and into said second opening for engagement with the small conductor.

* * * * *